US010816210B2

(12) United States Patent
Lind et al.

(10) Patent No.: US 10,816,210 B2
(45) Date of Patent: Oct. 27, 2020

(54) PREMIXED FUEL NOZZLE

(71) Applicant: General Electric Company, Schenectady, NY (US)

(72) Inventors: David Albin Lind, Lebanon, OH (US); Gregory Allen Boardman, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 338 days.

(21) Appl. No.: 15/718,077

(22) Filed: Sep. 28, 2017

(65) Prior Publication Data

US 2019/0093895 A1 Mar. 28, 2019

(51) Int. Cl.

| | |
|---|---|
| ***F23R 3/28*** | (2006.01) |
| ***F23R 3/04*** | (2006.01) |
| ***F23R 3/34*** | (2006.01) |

(52) U.S. Cl.

CPC ..... *F23R 3/286* (2013.01); *F23R 3/045* (2013.01); *F23R 3/343* (2013.01); *F23D 2900/00014* (2013.01); *F23D 2900/00015* (2013.01); *F23R 2900/00005* (2013.01); *F23R 2900/00014* (2013.01)

(58) Field of Classification Search

CPC ..... F23R 3/04; F23R 3/12; F23R 3/14; F23R 3/36; F23R 3/283; F23R 3/286; F23R 3/343; F23D 14/02; F23D 14/48; F23D 14/62; F23D 14/64; F23D 11/383; F23D 11/101; F23D 11/102

See application file for complete search history.

(56) References Cited

U.S. PATENT DOCUMENTS

| | | | | |
|---|---|---|---|---|
| 5,647,538 | A * | 7/1997 | Richardson | F23D 11/101 239/405 |
| 5,857,339 | A | 1/1999 | Roquemore et al. | |
| 6,360,776 | B1 | 3/2002 | McCormick et al. | |
| 6,367,262 | B1 * | 4/2002 | Mongia | F23R 3/14 60/748 |
| 7,007,477 | B2 | 3/2006 | Widener | |
| 7,461,509 | B2 | 12/2008 | Mick et al. | |
| 7,631,500 | B2 | 12/2009 | Mueller et al. | |
| 8,468,831 | B2 | 6/2013 | Venkataraman et al. | |
| 8,955,329 | B2 * | 2/2015 | Popovic | F23D 14/24 239/398 |
| 9,303,876 | B2 * | 4/2016 | Hernandez | F23R 3/14 |
| 9,513,010 | B2 | 12/2016 | Tseng et al. | |

(Continued)

*Primary Examiner* — Todd E Manahan
*Assistant Examiner* — David P. Olynick
(74) *Attorney, Agent, or Firm* — Dority & Manning, P.A.

(57) ABSTRACT

A fuel injector assembly for a gas turbine engine includes a centerbody extended along a lengthwise direction, the centerbody defining a first fuel nozzle, and an annular shroud defining a second fuel nozzle directly surrounding the centerbody and extended along the lengthwise direction. A passage is defined through the annular shroud and extended generally along the lengthwise direction. The passage defines an exit opening disposed at a downstream end adjacent to the combustion chamber and in fluid communication therewith. The annular shroud defines a fuel inlet opening disposed at an upstream end of the passage. The annular shroud defines an air inlet opening in fluid communication with the passage. The air inlet opening is disposed between the fuel inlet opening and the exit opening.

20 Claims, 6 Drawing Sheets

(56) References Cited

U.S. PATENT DOCUMENTS

| | | | | |
|---|---|---|---|---|
| 2007/0028618 | A1* | 2/2007 | Hsiao | F23R 3/14 60/737 |
| 2007/0028624 | A1* | 2/2007 | Hsieh | F23R 3/14 60/776 |
| 2009/0071158 | A1* | 3/2009 | Cazalens | F23R 3/286 60/737 |
| 2013/0152597 | A1 | 6/2013 | Durbin et al. | |
| 2015/0059346 | A1* | 3/2015 | Bunel | F23R 3/14 60/737 |
| 2015/0300647 | A1 | 10/2015 | Coogan et al. | |
| 2016/0252254 | A1* | 9/2016 | Bottcher | F23R 3/286 60/39.463 |

* cited by examiner

PREMIXED FUEL NOZZLE

FIELD

The present subject matter relates generally to gas turbine engine fuel injector and combustor assemblies.

BACKGROUND

Gas turbine engines are generally challenged to reduce emissions such as oxides of nitrogen ($NO_x$) formed due to the presence of nitrogen and oxygen at elevated temperatures during combustion. In high temperature combustion, such as above approximately 1530 C, $NO_x$ is produced in more significant quantities that present challenges for gas turbine engine design and operation. Above approximately 15030 C, the rate of $NO_x$ formation rapidly increases with further rises in combustion temperature.

Known structures and methods of $NO_x$ reduction in fuel injection and combustion systems are generally limited by other design criteria, including maintaining combustion stability (e.g., mitigating lean blow out) across the operating range of the engine, mitigating undesired combustion dynamics (e.g., pressure oscillations resulting from heat release during combustion), the resulting pattern factor (e.g., circumferential variations in combustion temperature), as well as other emissions, such as smoke, unburned hydrocarbons, carbon monoxide, and carbon dioxide.

Furthermore, fuel injector and combustor assemblies are generally challenged to mitigate wear and deterioration of fuel injector and combustor structures due to the high temperatures and high temperature gradients generally resulting from increasingly efficient gas turbine engines.

As such, there is a need for a fuel injector and combustor assembly that provides improved $NO_x$ emissions while maintaining combustion stability, mitigating combustion dynamics, maintaining desirable pattern factor and emissions, and mitigates wear and deterioration of fuel injector structures resulting from high temperature combustion.

Pressure oscillations generally occur in combustion sections of gas turbine engines resulting from the ignition of a fuel and air mixture within a combustion chamber. While nominal pressure oscillations are a byproduct of combustion, increased magnitudes of pressure oscillations may result from generally operating a combustion section at lean conditions, such as to reduce combustion emissions. Increased pressure oscillations may damage combustion sections and/or accelerate structural degradation of the combustion section in gas turbine engines, thereby resulting in engine failure or increased engine maintenance costs. As gas turbine engines are increasingly challenged to reduce emissions, structures for attenuating combustion gas pressure oscillations are needed to enable reductions in gas turbine engine emissions while maintaining or improving the structural life of combustion sections.

BRIEF DESCRIPTION

Aspects and advantages of the invention will be set forth in part in the following description, or may be obvious from the description, or may be learned through practice of the invention.

The present disclosure is directed to a fuel injector assembly and a gas turbine engine including the fuel injector assembly. The fuel injector assembly includes a centerbody extended along a lengthwise direction. The centerbody defines a first fuel nozzle. An annular shroud defining a second fuel nozzle surrounds the centerbody and is extended along the lengthwise direction. A passage is defined through the annular shroud and extended generally along the lengthwise direction. The passage defines an exit opening disposed at a downstream end adjacent to the combustion chamber and in fluid communication therewith. The annular shroud defines a fuel inlet opening disposed at an upstream end of the passage. The annular shroud further defines an air inlet opening in fluid communication with the passage. The air inlet opening is disposed between the fuel inlet opening and the exit opening.

The inlet opening provides a quantity of air to the passage and the fuel inlet opening provides a quantity of fuel through the passage. The passage defines a fuel-air mixing passage through which the quantity of air and the quantity of fuel egress through the exit opening.

In one embodiment, the passage is defined approximately annularly through the shroud, and wherein the exit opening is defined approximately annularly through the shroud. In another embodiment, the air inlet opening is defined as a plurality of discrete openings through the annular shroud in fluid communication with the passage. In yet another embodiment, the air inlet opening defines a volume providing a quantity of air to the passage at a pressure greater than the quantity of fuel within the passage. The quantity of air prevents the quantity of fuel from egressing through the air inlet opening. In still yet another embodiment, the passage defines a first cross sectional area upstream of the air inlet opening and a second cross sectional area approximately at and downstream of the air inlet opening. The second cross sectional area is greater than the first cross sectional area.

In various embodiments, a reference centerline is extended through the passage within the annular shroud at least partially along the lengthwise direction. The air inlet opening is disposed approximately perpendicular to the reference centerline. In another embodiment, the air inlet opening is disposed at an acute angle relative to the reference centerline. The annular shroud defines a first opening of the air inlet opening adjacent to the combustion chamber and a second opening of the air inlet opening downstream of the first opening and adjacent to the passage.

In still another embodiment, the annular shroud defines a walled chute extended at least partially outward along a radial direction from a nozzle centerline. The walled chute is extended at the air inlet opening and defines a generally straight wall or curvature directing a quantity of air into the air inlet opening. In another embodiment, the annular shroud defines the air inlet opening as defining a first opening adjacent to the combustion chamber and a second opening adjacent to the passage. The air inlet opening defines a generally decreasing cross sectional area from the first opening to the second opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
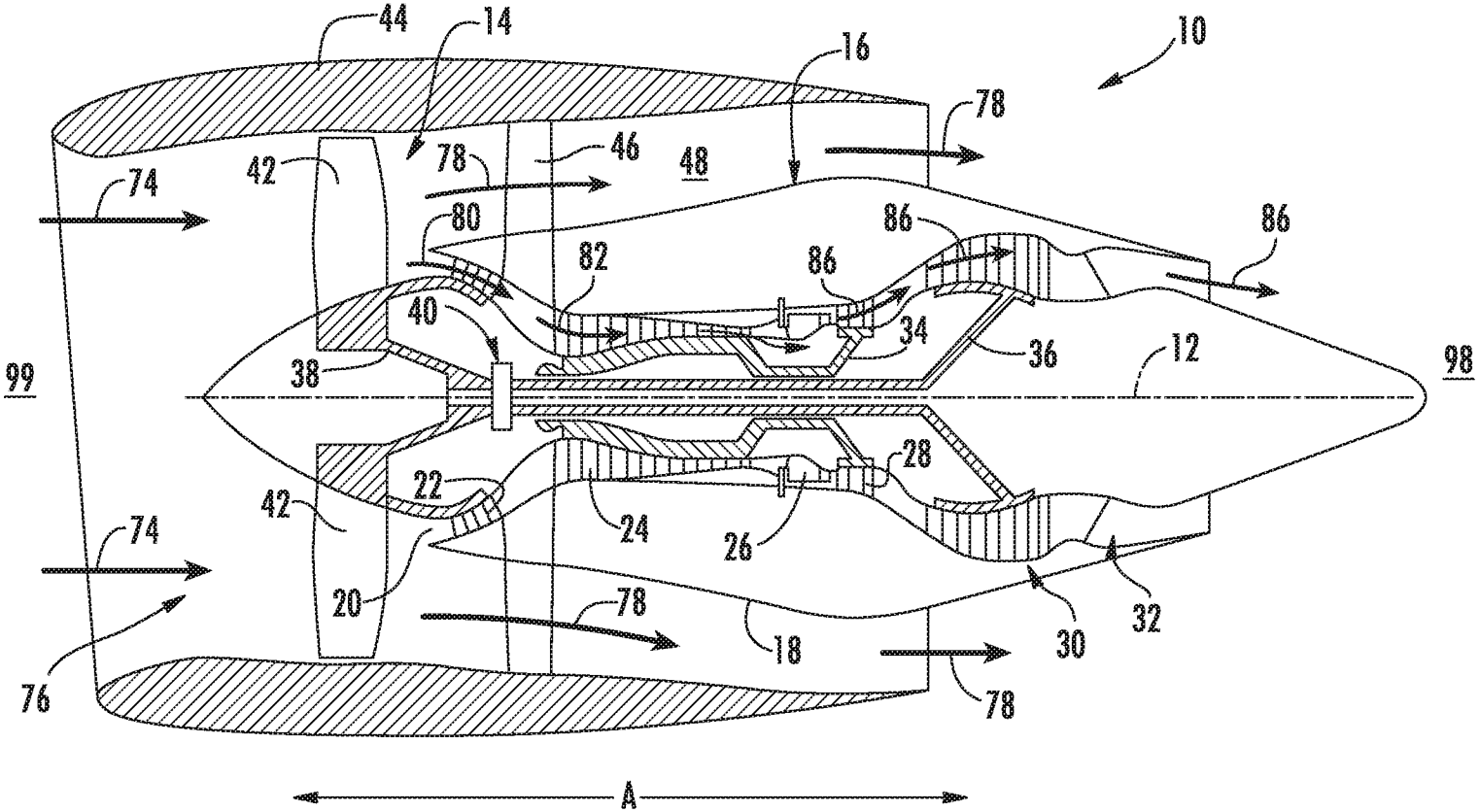
FIG. 1 is a schematic cross-sectional view of an exemplary embodiment of a gas turbine engine.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows. The terms "upstream of" or "downstream of" generally refer to directions toward "upstream 99" or toward "downstream 98", respectively, as provided in the figures.

Embodiments of a gas turbine engine including embodiments of a fuel injector assembly are generally provided that may improve $NO_x$ emissions while maintaining combustion stability, mitigating combustion dynamics, maintaining desirable pattern factor and emissions, and mitigating wear and deterioration of fuel injector structures resulting from high temperature combustion. The fuel injector assembly may generally define an enhanced lean blow out (ELBO) fuel injector assembly defining a first fuel nozzle as a pilot fuel nozzle and a second fuel nozzle as a main fuel nozzle. A quantity of air enters through an air inlet opening in the second fuel nozzle to ingress air in a fuel-air mixing passage to produce a fuel-air mixture within the passage that enables lowering a local equivalence ratio and flame temperature. The resulting lower equivalence ratio and flame temperature reduces emissions of oxides of nitrogen while providing approximately similar flame stabilization and combustion dynamics suppression as known fuel injector assemblies. The lower flame temperature produced by the fuel-air mixture from the annular shroud improves structural durability and reduces wear at the annular shroud by reducing a thermal gradient and thermal stresses at the annular shroud of the second fuel nozzle. Furthermore, the annular shroud defining the air inlet opening prevents ingestion of combustion gases into the passage by providing a flow of air through the passage when fuel is not flowing therethrough. The flow of air then egresses the passage through the exit opening into the combustion chamber to create a buffer of air at the annular shroud, keeping combustion gases away therefrom.

Referring now to the drawings, FIG. 1 is a schematic partially cross-sectioned side view of an exemplary high by-pass turbofan engine 10 herein referred to as "engine 10" as may incorporate various embodiments of the present disclosure. Although further described below with reference to a turbofan engine, the present disclosure is also applicable to propulsion systems and turbomachinery in general, including turbojet, turboprop, and turboshaft gas turbine engines and marine and industrial turbine engines and auxiliary power units. As shown in FIG. 1, the engine 10 has a longitudinal or axial centerline axis 12 that extends there through for reference purposes and generally along an axial direction A. The engine 10 further defines an upstream end 99 and a downstream 98 generally opposite of the upstream end 99 along the axial direction A. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
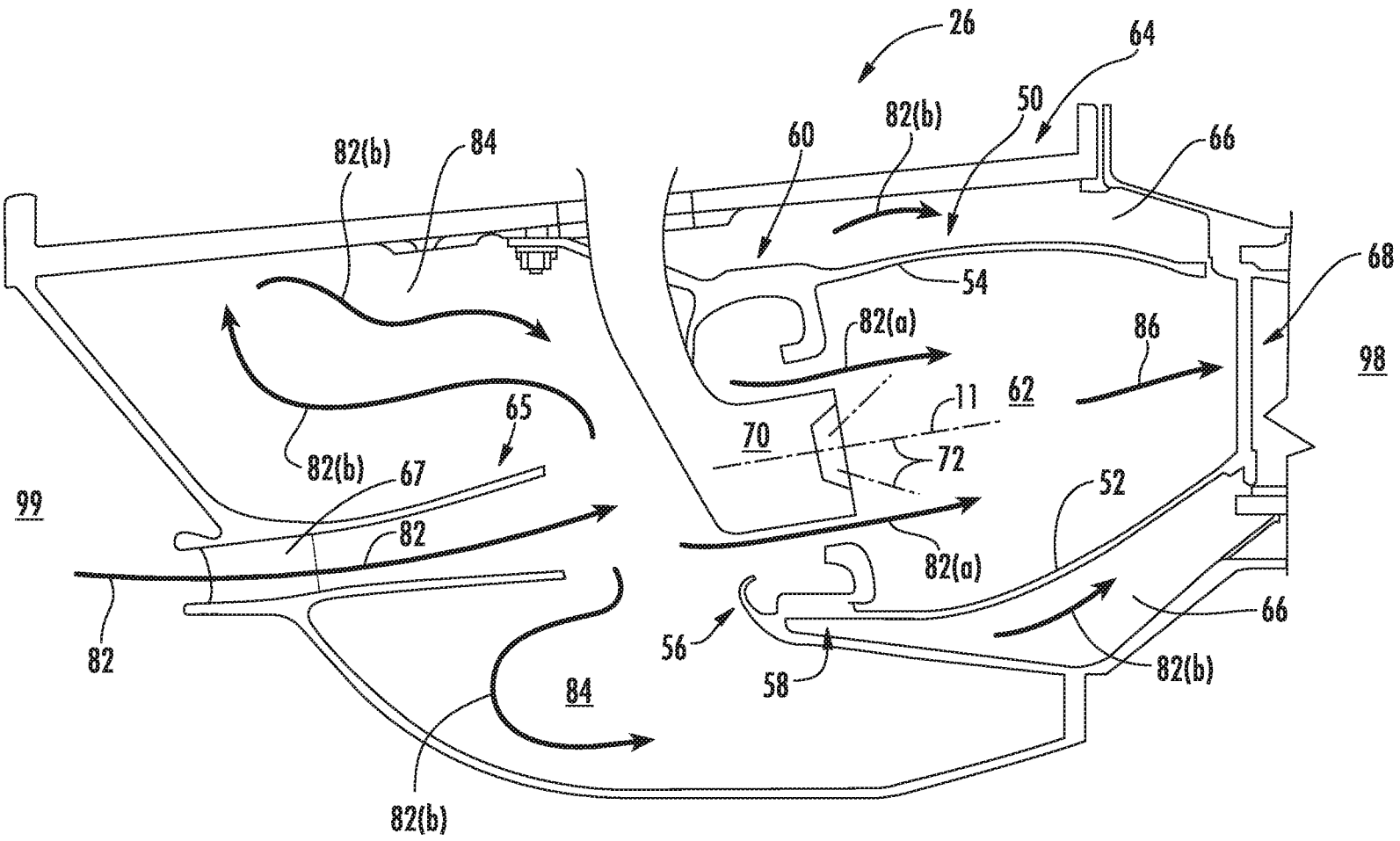
FIG. 2 is a cross sectional side view of an exemplary embodiment of a combustor assembly of the gas turbine engine generally provided in FIG. 1.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a dome wall 56 that extends radially between upstream ends 58, 60 of the inner liner 52 and the outer liner 54 respectfully. In other embodiments of the combustion section 26, the combustion assembly 50 may be a can or can-annular type. As shown in FIG. 2, the inner liner 52 is radially spaced from the outer liner 54 with respect to axial centerline 12 (FIG. 1) and defines a generally annular combustion chamber 62 therebetween.

As shown in FIG. 2, the inner liner 52 and the outer liner 54 may be encased within an outer casing 64. An outer flow passage 66 may be defined around the inner liner 52, the outer liner 54, or both. The inner liner 52 and the outer liner 54 may extend from the dome wall 56 towards a turbine nozzle or inlet 68 to the HP turbine 28 (FIG. 1), thus at least partially defining a hot gas path between the combustor assembly 50 and the HP turbine 28. A fuel injector assembly 70 may extend at least partially through the dome wall 56 and provide a fuel-air mixture 72 to the combustion chamber 62.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 and through a prediffuser 65 into a diffuser cavity or head end portion 84 of the combustion section 26.

The prediffuser 65 and CEGV 67 condition the flow of compressed air 82 to the fuel injector assembly 70. The compressed air 82 pressurizes the diffuser cavity 84. The compressed air 82 enters the fuel injector assembly 70 to mix with a fuel. The fuel nozzles 70 premix fuel and air 82 within the array of fuel injectors with little or no swirl to the resulting fuel-air mixture 72 exiting the fuel injector assembly 70. After premixing the fuel and air 82 within the fuel nozzles 70, the fuel-air mixture 72 burns from each of the plurality of fuel nozzles 70 as an array of flames.

Referring still to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

As the fuel-air mixture burns, pressure oscillations occur within the combustion chamber 62. These pressure oscillations may be driven, at least in part, by a coupling between the flame's unsteady heat release dynamics, the overall acoustics of the combustor 50 and transient fluid dynamics within the combustor 50. The pressure oscillations generally result in undesirable high-amplitude, self-sustaining pressure oscillations within the combustor 50. These pressure oscillations may result in intense, frequently single-frequency or multiple-frequency dominated acoustic waves that may propagate within the generally closed combustion section 26.

Depending, at least in part, on the operating mode of the combustor 50, these pressure oscillations may generate acoustic waves at a multitude of low or high frequencies. These acoustic waves may propagate downstream from the combustion chamber 62 towards the high pressure turbine 28 and/or upstream from the combustion chamber 62 back towards the diffuser cavity 84 and/or the outlet of the HP compressor 24. In particular, as previously provided, low frequency acoustic waves, such as those that occur during engine startup and/or during a low power to idle operating condition, and/or higher frequency waves, which may occur at other operating conditions, may reduce operability margin of the turbofan engine and/or may increase external combustion noise, vibration, or harmonics.

Figure 3:
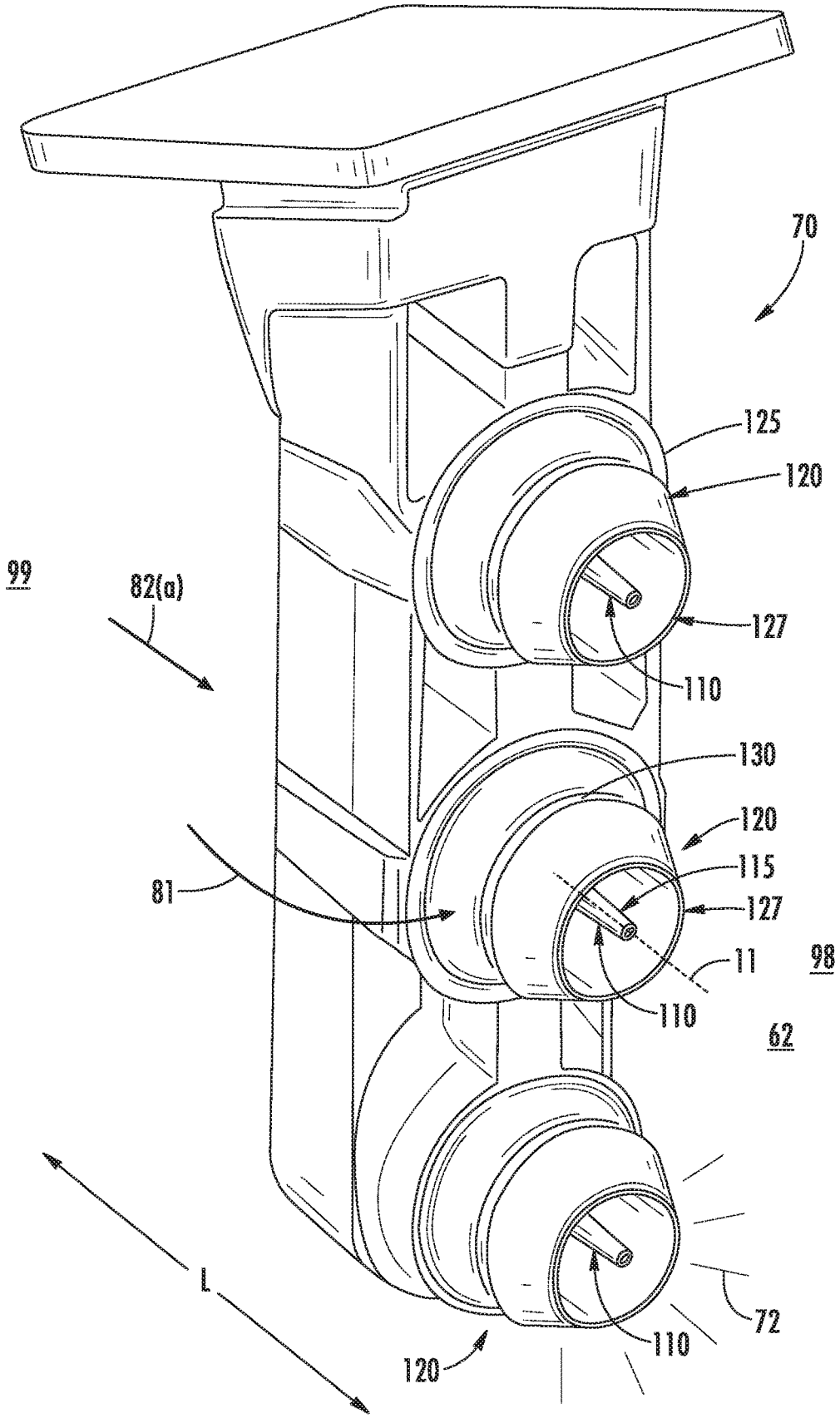
FIG. 3 is a perspective view of an exemplary embodiment of a fuel injector assembly of the combustor assembly generally provided in FIG. 2.

Referring now to the perspective view of the exemplary embodiment of the fuel injector assembly 70 generally provided in FIG. 3, the fuel injector assembly 70 includes a centerbody 115 extended along the lengthwise direction L. The fuel injector assembly 70 defines a nozzle centerline 11 extended through the centerbody 115 of the fuel injector assembly 70 along the lengthwise direction L. The centerbody 115 defines a first fuel nozzle 110. An annular shroud 125 defining a second fuel nozzle 120 surrounds the centerbody 115 and is extended along the lengthwise direction L.

The annular shroud 125 defines an exit opening 127 disposed at the downstream end 98 of the annular shroud 125 adjacent to, and in fluid communication with, the combustion chamber 62. The annular shroud 125 further defines an air inlet opening 130 through the annular shroud 125 that permits a portion of the compressed air 82(*a*) from the compressor section 21, shown schematically by arrows 81, to ingress into the annular shroud 125. The flow of air 81 mixes with a fuel 71 shown in FIGS. 4-6) to produce a fuel-air mixture 72 within the annular shroud 125 that then egresses through the exit opening 127 to combust in the combustion chamber 62 to produce combustion gases 86 (shown in FIGS. 1-2).

Figure 4:
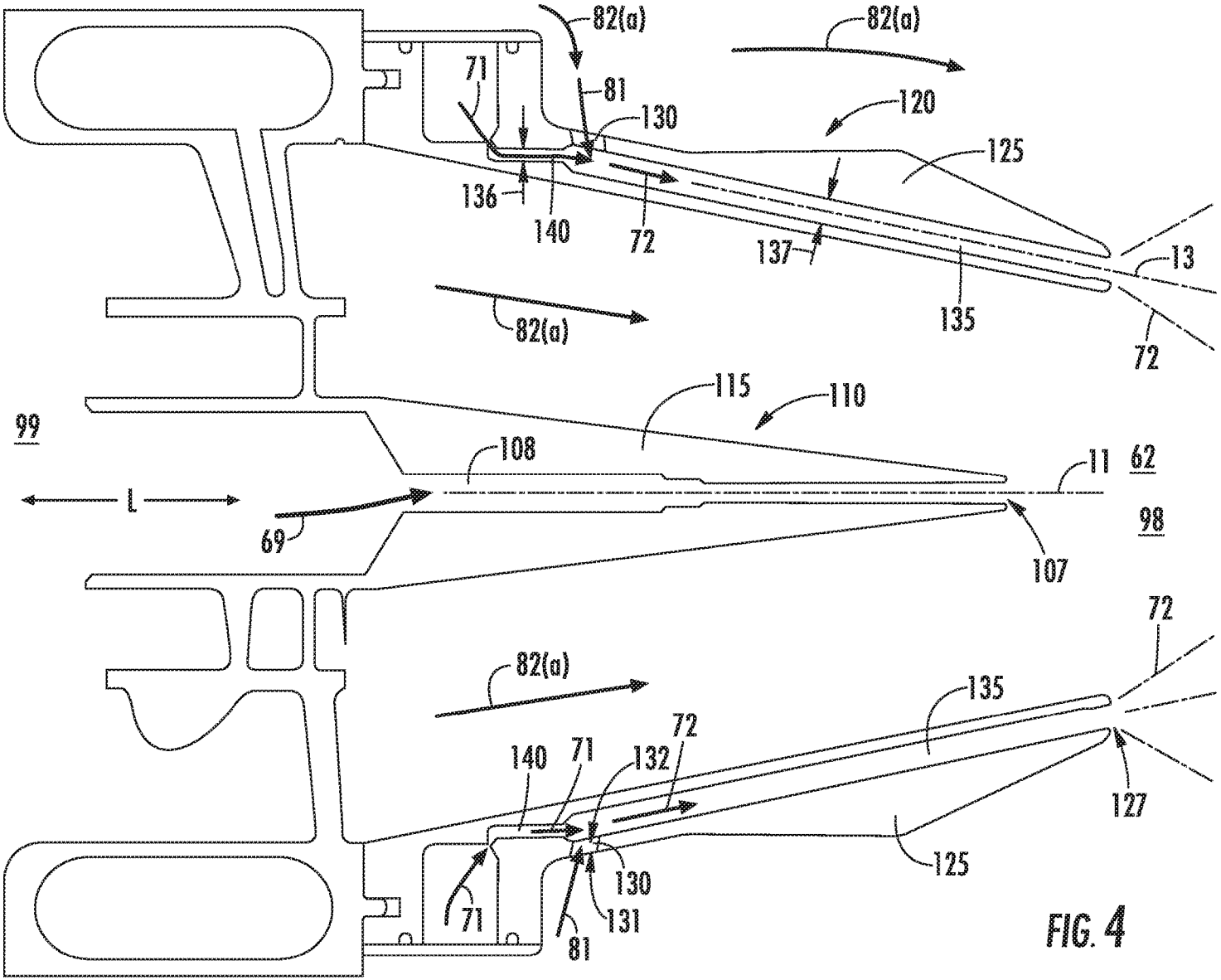
FIGS. 4, 5, and 6 are each axial cross sectional views of embodiments of the fuel injector assembly generally provided in FIG. 3.
Figure 5:
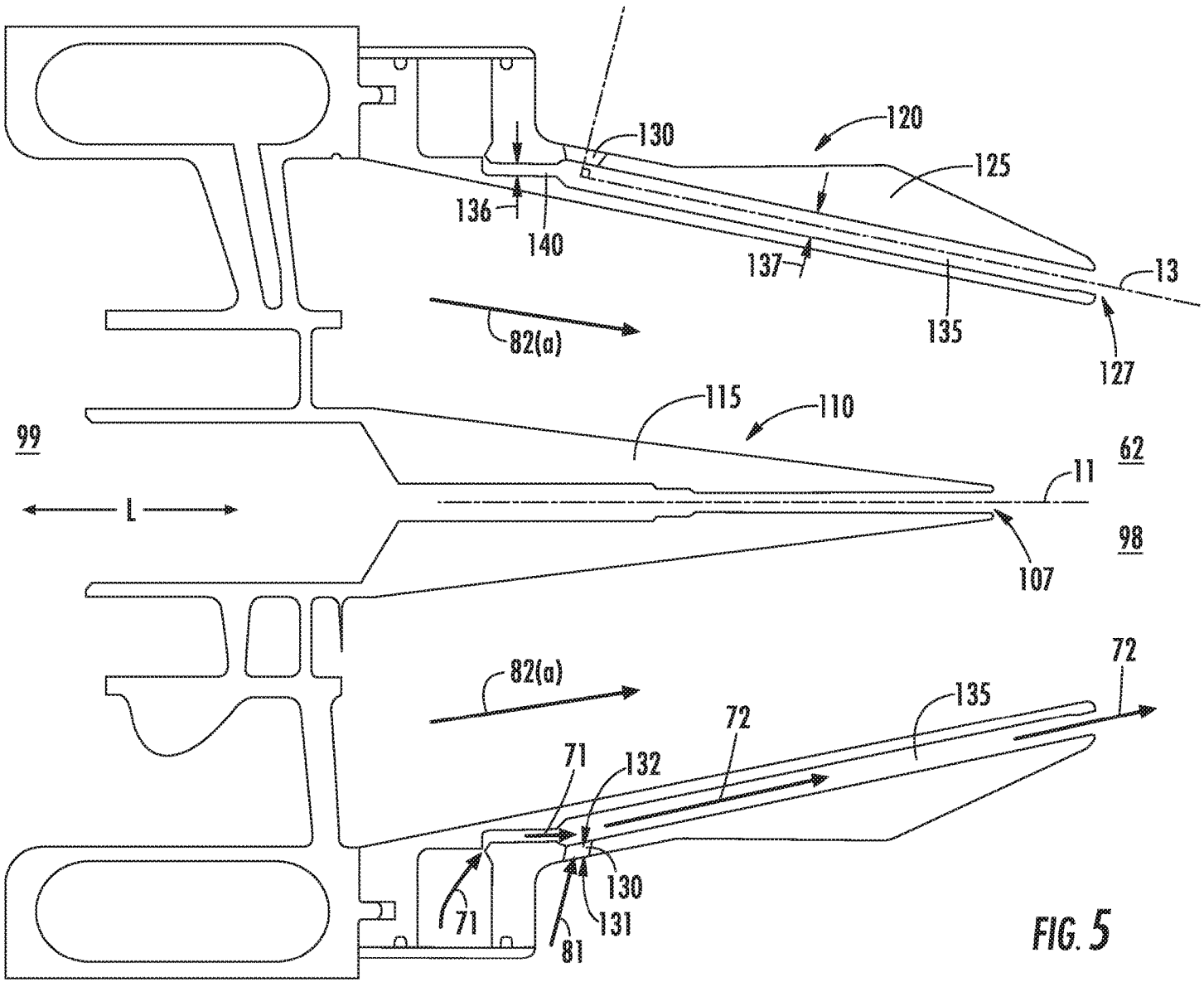
Figure 6:
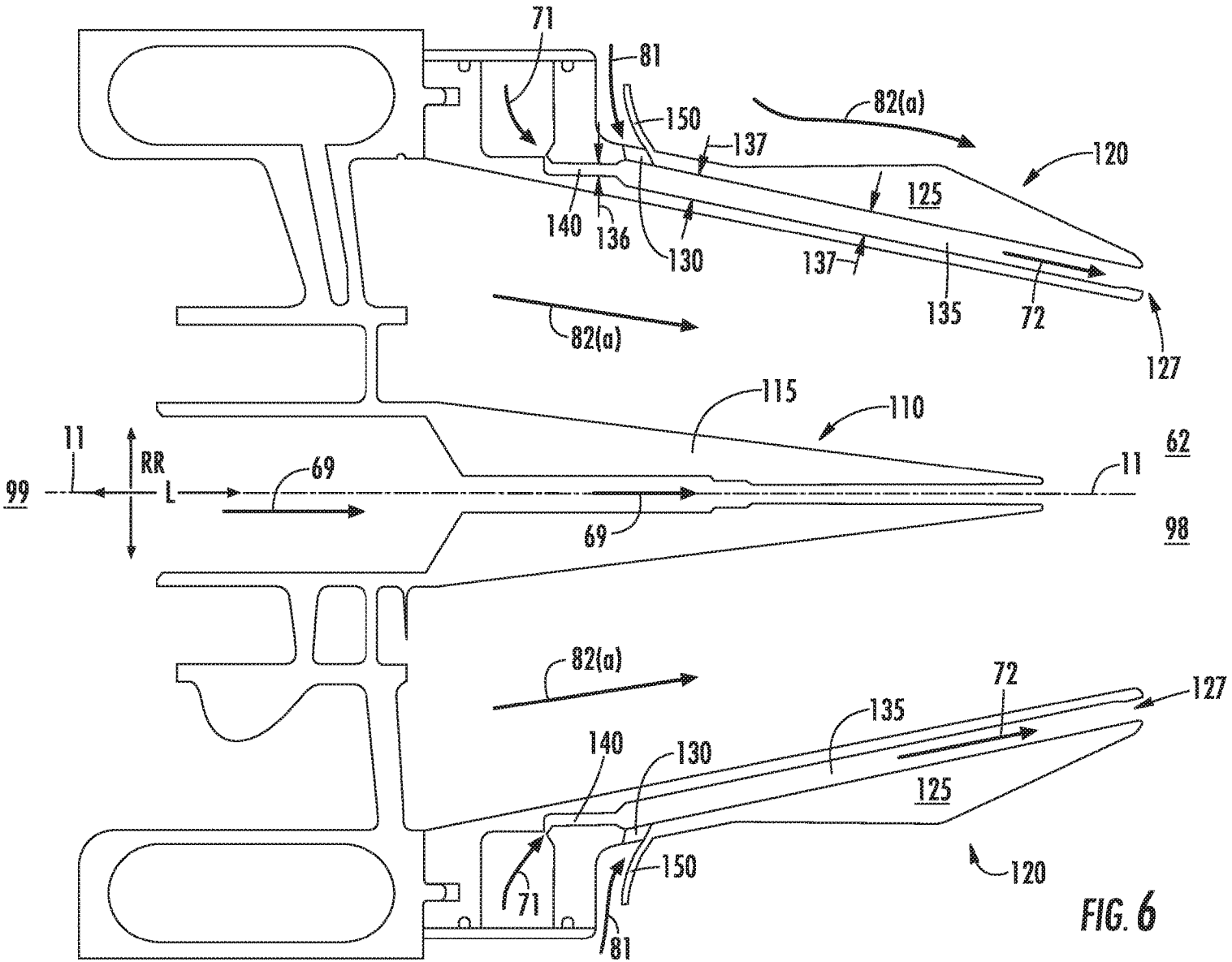

Referring now to the axial cross sectional view of the exemplary embodiments of the fuel injector assembly 70 generally provided in FIGS. 4-6, a passage 135 is defined through the annular shroud 125 and extended generally along the lengthwise direction L. The annular shroud 125 defines the exit opening 127 disposed at the downstream end 98 of the passage 135 adjacent to the combustion chamber 62. The annular shroud 125 further defines a fuel inlet opening 140 disposed at the upstream end 99 of the passage 135. The annular shroud 125 defines the air inlet opening 130 in fluid communication with the passage 135. The air inlet opening 130 is disposed between the fuel inlet opening 140 and the exit opening 127.

In various embodiments, the exit opening 127 is defined as a plurality of discrete openings 127 through the annular shroud 125 in circumferentially adjacent arrangement. In one embodiment, the exit opening 127 is defined as a generally circular cross sectional opening. In other embodiments, the exit opening 127 is defined as an ovular, rectangular, polygonal, or oblique cross sectional area. In still other embodiments, the fuel injector assembly 70 may define a plurality of cross sectional areas of the exit opening 127 at each annular shroud 125. For example, the annular shroud 125 may define a plurality of cross sectional areas of the exit opening 127 in adjacent circumferential arrangement.

Referring still to FIGS. 4-6, the fuel injector assembly 70 defines a centerbody exit orifice 107 through the centerbody 115 through which a quantity of fuel 69 egresses into the combustion chamber 62. The centerbody exit orifice 107 is generally defined concentric to the nozzle centerline 11. In various embodiments, the centerbody exit orifice 107 defines an outlet of a centerbody passage 108 defined within the centerbody 115. A fuel or fuel-air mixture flows through the centerbody passage 108 and egresses into the combustion chamber 62 through the centerbody exit orifice 107.

In one embodiment, the first fuel nozzle 110 defines a pilot fuel nozzle configured to provide fuel or a fuel-air mixture 69 for combustion in the combustion chamber 62 to operate the engine 10 at initial startup or ignition, or re-light (e.g., altitude re-light), and low power conditions. The first fuel nozzle 110 defining a pilot fuel nozzle may be configured to provide low emissions and improved operability, combustion stability, and performance at low power conditions (e.g., sub-idle and idle conditions). In general, the pilot fuel nozzle may be operable throughout the range of operating conditions of the engine 10, such as from ignition to maximum power. As such, the first fuel nozzle 110 may be configured to constantly flow a fuel or fuel-air mixture through the centerbody passage 108 to the combustion chamber 62.

In another embodiment, the second fuel nozzle 120 defines a main fuel nozzle configured to provide fuel 71 and fuel-air mixture 72 for combustion in the combustion chamber 62 to operate the engine 10 at mid-power and high-power conditions (e.g., cruise, approach, climb, takeoff conditions in aero applications, or part-load to full load conditions generally in power generating applications). The quantity of air 81 entering the passage 135 and mixing with the fuel 71 therein to produce the fuel-air mixture 72 within the passage 135 enables lowering a local equivalence ratio and flame temperature. The resulting lower equivalence ratio and flame temperature reduces emissions of oxides of nitrogen ($NO_x$) while providing approximately similar flame stabilization and combustion dynamics suppression as known fuel injector assemblies, such as enhanced lean-blow out (ELBO) fuel injector assemblies.

In still various embodiments, the lower flame temperature produced by the fuel-air mixture 72 from the annular shroud 125 improves structural durability and reduces wear at the annular shroud 125, or more specifically, the downstream end 98 of the annular shroud proximate to the resultant flame produced by the fuel-air mixture 72 egressing the exit opening 127. For example, introducing into the annular shroud 125 the quantity of air 81 through the air inlet opening 130 raises a temperature of fluid (i.e., the fuel-air mixture 72) flowing through annular shroud 125 in contrast to a temperature of fuel 71. The higher temperature of the fuel-air mixture 72 within the passage 135 of the annular shroud 125 reduces a thermal gradient, and subsequently, thermal stresses, at the annular shroud 125. More specifically, the higher temperature of the fuel-air mixture 72 within the passage 135 reduces a difference in temperature between the fuel-air mixture 72 and the resultant flame produced therefrom in the combustion chamber 62, which thereby reduces the thermal gradient and thermal stresses at the annular shroud 125 proximate to the resultant flame (e.g., the downstream end 98 of the annular shroud 125).

Furthermore, the annular shroud 125 defining the air inlet opening 130 prevents ingestion of combustion gases 86 into the passage 135 by providing a flow of air 81 through the passage 135 when fuel 71 is not flowing therethrough. The flow of air 81 then egresses the passage 135 through the exit opening 127 to create a buffer of air 81 at the annular shroud 125 keeping combustion gases 86 away therefrom.

Referring still to FIGS. 4-6, in one embodiment, the passage 135 is defined approximately annularly through the annular shroud 125, such as generally concentric around the nozzle centerline 11. The exit opening 127 is further defined approximately annularly through the shroud 125. However, it should be appreciated that one or more walls may extend within the passage 135 to provide structural support for the annular shroud 125. As such, in other embodiments, the passage 135 is defined is a plurality of discrete passages in circumferential arrangement around the nozzle centerline 11, in which each passage 135 is separated by one or more walls extended along the lengthwise direction L and disposed at one or more circumferential locations around the nozzle centerline 11. Similarly, the air inlet opening 130 may be defined as a plurality of discrete openings through the annular shroud 125 in fluid communication with the passage 135.

In one embodiment, the plurality of discrete passages 135, the plurality of air inlet openings 130, or both, may each define a generally uniform structure (e.g., volume, cross sectional area, flowpath shape, etc.) among the plurality of circumferentially arranged passages 135. In another embodiment, the plurality of discrete passages 135, the plurality of air inlet openings 130, or both may each define a multitude or variety (e.g., two or more) structures different from one another. In yet another embodiment, each annular shroud 125 of each fuel injector assembly 70 may define a generally uniform structure of the plurality of discrete passages 135, the plurality of air inlet openings 130, or both, relative to one another within each annular shroud 125. In still yet another embodiment, each annular shroud 125 of the combustor assembly 50 may define a multitude or plurality of annular shroud 125 each defining two or more structures of the plurality of passages 135, the plurality of air inlet openings 130, or both different from each annular shroud 125 (e.g., a first annular shroud, a second annular shroud, an Nth annular shroud, each defining a different passage 135, air inlet opening 130, or both, relative to one another).

In still another embodiment, the air inlet opening 130 defines a volume providing a quantity of air 81 to the passage 135 at a pressure greater than the quantity of fuel 71 within the passage 135. The higher pressure of the quantity of air 81 prevents the quantity of fuel 71 from back-flowing or egressing through the air inlet opening 130.

In one embodiment of the fuel injector assembly 70, the passage 135 defines a first cross sectional area 136 upstream of the air inlet opening 130 and a second cross sectional area 137 approximately at and downstream of the air inlet opening 130 in which the second cross sectional area 137 is greater than the first cross sectional area 136. The greater second cross sectional area 137 may produce a pressure differential relative to the first cross sectional area 136 within the passage 135 that mitigates a back-flow of the air 81 upstream toward and into the fuel inlet opening 470. The greater second cross sectional area 137 relative to the first cross sectional area 136 may further enable flow and mixing of the fuel 71 and air 81 to produce the fuel-air mixture 72.

In various embodiments, the annular shroud 125 defines a first opening 131 at the air inlet opening 130 adjacent outward of the annular shroud 125, such as adjacent to the combustion chamber 62. The annular shroud 125 further defines a second opening 132 at the air inlet opening 130 downstream of the first opening 131 along the lengthwise direction L and adjacent to the passage 135.

In various embodiments, the air inlet opening 130 may be disposed at different distances along the passage 135 relative to other passages 135 or fuel injector assemblies 70. For example, the air inlet opening 130 may be disposed further downstream relative to the fuel inlet opening 140 of each passage 135. In one embodiment, the air inlet opening 130 may be disposed within approximately 10 diameter lengths of the fuel inlet opening 140. In another embodiment, the air inlet opening 130 may be disposed within approximately three diameter lengths of the fuel inlet opening 140. In still other embodiments, the air inlet opening 130 may be disposed within one diameter length of the fuel inlet opening 140. For example, the second opening 132 of the air inlet opening 130 may be defined within approximately three diameter lengths of the intersection of the fuel inlet opening 140 and the passage 135. As another example, the second opening 132 may be defined within approximately one diameter length of the intersection of the fuel inlet opening 140 and the passage 135.

Referring now to FIGS. 4-5, a reference centerline 13 is extended through the passage 135 within the annular shroud 125 at least partially along the lengthwise direction L. In one embodiment of the fuel injector assembly 70, such as generally provided in FIG. 4, the air inlet opening 130 is disposed at an acute angle relative to the reference centerline 13. For example, the first opening 131 of the air inlet opening 130 is defined upstream along the lengthwise direction L of the second opening 132. In another embodiment, such as generally provided in FIG. 5, the air inlet opening 130 is disposed approximately perpendicular to the reference centerline 13.

In still various embodiments, the annular shroud 125 defines the air inlet opening 130 as a generally decreasing cross sectional area along the downstream direction (i.e., along the flow of air 81 from the combustion chamber 62 to the passage 135). For example, the annular shroud 125 may define the first opening 131 of a greater cross sectional area than the second opening 132. The cross sectional area between the first opening 131 and the second opening 132 may be generally decreasing between the first opening 131 and the second opening 132, such as generally provided in FIG. 5.

Referring now to FIG. 6, the annular shroud 125 may further define a walled chute 150 extended at least partially outward along a radial direction RR from the nozzle centerline 11. The walled chute 150 is extended from the annular shroud 125 at the air inlet opening 130 such as to direct or guide the flow of air 81 into the air inlet opening 130 through the annular shroud 125. The walled chute 150 may define a generally straight wall or curvature, such as defining a scoop or hood, directing the quantity of air 81 into the air inlet opening 130.

Various embodiments of the combustor assembly 50 may include one or more fuel injector assemblies 70 defining a fuel-only passage 135 (i.e., no air-inlet opening 130) in adjacent arrangement through the annular shroud 125 with one or more passages 135 further defining one or more embodiments of the air inlet opening 130 as shown and described in regard to FIGS. 1-6. In one embodiment, the combustor assembly 50 may include one or more fuel injector assemblies defining a fuel only passage 135 and one or more fuel injector assemblies 70 such as shown and described in regard to FIGS. 1-6.

All or part of the combustor assembly 50 and fuel injector assembly 70 may each be part of a single, unitary component and may be manufactured from any number of processes commonly known by one skilled in the art. These manufacturing processes include, but are not limited to, those referred to as "additive manufacturing" or "3D printing". Additionally, any number of casting, machining, welding, brazing, or sintering processes, or any combination thereof may be utilized to construct the fuel injector assembly 70. Furthermore, the combustor assembly 50 may constitute one or more individual components that are mechanically joined (e.g. by use of bolts, nuts, rivets, or screws, or welding or brazing processes, or combinations thereof) or are positioned in space to achieve a substantially similar geometric, aerodynamic, or thermodynamic results as if manufactured or assembled as one or more components. Non-limiting examples of suitable materials include high-strength steels, nickel and cobalt-based alloys, and/or metal or ceramic matrix composites, or combinations thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel injector assembly for a gas turbine engine, the fuel injector assembly comprising:
- a centerbody extended along a lengthwise direction, the centerbody defining a first fuel nozzle; and
- an annular shroud defining a second fuel nozzle directly surrounding the centerbody and extended along the lengthwise direction,
- wherein a passage is defined through the annular shroud and extended generally along the lengthwise direction,
- wherein the annular shroud comprises a straight solid annular shroud wall,
- wherein a portion of the straight solid annular shroud wall delimits an inner radial side of the passage and directly surrounds the first fuel nozzle,
- wherein the passage defines an exit opening disposed at a downstream end configured to be adjacent to a combustion chamber and in fluid communication therewith,
- wherein the annular shroud defines a fuel inlet opening disposed at an upstream end of the passage,
- wherein the annular shroud defines an air inlet opening in fluid communication with the passage, and
- wherein the air inlet opening is disposed between the fuel inlet opening and the exit opening.

2. The fuel injector assembly of claim 1,
- wherein the inlet opening provides a quantity of air to the passage,
- wherein the fuel inlet opening provides a quantity of fuel through the passage, and
- wherein the passage defines a fuel-air mixing passage through which the quantity of air and the quantity of fuel egress through the exit opening.

3. The fuel injector assembly of claim 1,
- wherein the passage is defined approximately annularly through the shroud, and
- wherein the exit opening is defined approximately annularly through the shroud.

4. The fuel injector assembly of claim 1, wherein the air inlet opening is defined as a plurality of discrete openings through the annular shroud in fluid communication with the passage.

5. The fuel injector assembly of claim 1, wherein the air inlet opening defines a volume providing a quantity of air to the passage at a pressure greater than the quantity of fuel within the passage, the quantity of air preventing the quantity of fuel from egressing through the air inlet opening.

6. The fuel injector assembly of claim 1,
- wherein the passage defines a first cross sectional area upstream of the air inlet opening and a second cross sectional area downstream of the air inlet opening, and wherein the second cross sectional area is greater than the first cross sectional area.

7. The fuel injector assembly of claim 1, wherein a reference centerline is extended through the passage within the annular shroud at least partially along the lengthwise direction, and wherein the air inlet opening is disposed approximately perpendicular to the reference centerline.

8. The fuel injector assembly of claim 1, wherein a reference centerline is extended through the passage within the annular shroud at least partially along the lengthwise direction, and wherein the air inlet opening is disposed at an acute angle relative to the reference centerline, the annular shroud defining a first opening of the air inlet opening adjacent to the combustion chamber and a second opening of the air inlet opening downstream of the first opening and adjacent to the passage.

9. The fuel injector assembly of claim 1, wherein the annular shroud defines a walled chute extended at least partially outward along a radial direction from a nozzle centerline, the walled chute extended at the air inlet opening, and wherein the walled chute defines a generally straight wall or curvature directing a quantity of air into the air inlet opening.

10. The fuel injector assembly of claim 1, wherein the annular shroud defines the air inlet opening as defining a first opening adjacent to the combustion chamber and a second opening adjacent to the passage, and wherein the air inlet opening defines a generally decreasing cross sectional area from the first opening to the second opening.

11. A gas turbine engine, comprising:

a combustor assembly defining a combustion chamber, the combustor assembly comprising one or more fuel injector assemblies extended at least partially into the combustion chamber, wherein the one or more fuel injector assemblies comprises:

a centerbody extended along a lengthwise direction, the centerbody defining a first fuel nozzle; and an annular shroud defining a second fuel nozzle directly surrounding the centerbody and extended along the lengthwise direction, wherein a passage is defined through the annular shroud and extended generally along the lengthwise direction, wherein the annular shroud comprises a straight solid annular shroud wall, wherein a portion of the straight solid annular shroud wall delimits an inner radial side of the passage and directly surrounds the first fuel nozzle, wherein the passage defines an exit opening disposed at a downstream end adjacent to the combustion chamber and in fluid communication therewith, wherein the annular shroud defines a fuel inlet opening disposed at an upstream end of the passage, and wherein the annular shroud defines an air inlet opening in fluid communication with the passage, and wherein the air inlet opening is disposed between the fuel inlet opening and the exit opening.

12. The gas turbine engine of claim 11, wherein the inlet opening provides a quantity of air to the passage, wherein the fuel inlet opening provides a quantity of fuel through the passage, and wherein the passage defines a fuel-air mixing passage through which the quantity of air and the quantity of fuel egress through the exit opening.

13. The gas turbine engine of claim 11, wherein the passage is defined approximately annularly through the shroud, and wherein the exit opening is defined approximately annularly through the shroud.

14. The gas turbine engine of claim 11, wherein the air inlet opening is defined as a plurality of discrete openings through the annular shroud in fluid communication with the passage.

15. The gas turbine engine of claim 11, wherein the air inlet opening defines a volume providing a quantity of air to the passage at a pressure greater than the quantity of fuel within the passage, the quantity of air preventing the quantity of fuel from egressing through the air inlet opening.

16. The gas turbine engine of claim 11, wherein the passage defines a first cross sectional area upstream of the air inlet opening and a second cross sectional area downstream of the air inlet opening, and wherein the second cross sectional area is greater than the first cross sectional area.

17. The gas turbine engine of claim 11, wherein a reference centerline is extended through the passage within the annular shroud at least partially along the lengthwise direction, and wherein the air inlet opening is disposed approximately perpendicular to the reference centerline.

18. The gas turbine engine of claim 11, wherein a reference centerline is extended through the passage within the annular shroud at least partially along the lengthwise direction, and wherein the air inlet opening is disposed at an acute angle relative to the reference centerline, the annular shroud defining a first opening of the air inlet opening adjacent to the combustion chamber and a second opening of the air inlet opening downstream of the first opening and adjacent to the passage.

19. The gas turbine engine of claim 11, wherein the annular shroud defines a walled chute extended at least partially outward along a radial direction from a nozzle centerline, the walled chute extended at the air inlet opening, and wherein the walled chute defines a generally straight wall or curvature directing a quantity of air into the air inlet opening.

20. The gas turbine engine of claim 11, wherein the annular shroud defines the air inlet opening as defining a first opening adjacent to the combustion chamber and a second opening adjacent to the passage, and wherein the air inlet opening defines a generally decreasing cross sectional area from the first opening to the second opening.

* * * * *